US006006932A

United States Patent [19]

Morini

[11] Patent Number: 6,006,932

[45] Date of Patent: Dec. 28, 1999

[54] CAPSULE FOR SECURITY CLOSURE OF CONTAINERS

[75] Inventor: Emilio Morini, Colorno, Italy

[73] Assignee: Bormioli Rocco & Figlio S.p.A., Parma, Italy

[21] Appl. No.: 09/125,196

[22] PCT Filed: Dec. 23, 1996

[86] PCT No.: PCT/IT96/00265

§ 371 Date: Aug. 13, 1998

§ 102(e) Date: Aug. 13, 1998

[87] PCT Pub. No.: WO97/31839

PCT Pub. Date: Sep. 4, 1997

[30] Foreign Application Priority Data

Feb. 29, 1996 [IT] Italy ..... MO96A0022

[51] Int. Cl.[6] ..... B65D 39/00; B65D 41/34; B65D 51/18

[52] U.S. Cl. ..... 215/249; 215/204; 215/213; 215/251; 215/256; 220/257

[58] Field of Search ..... 215/249, 247, 215/251, 252, 253, 258, 204, 211, 213, 217, 250, 254, 256; 220/254, 256, 257, 258, 265, 266, 276

[56] References Cited

U.S. PATENT DOCUMENTS

| | | | |
|---|---|---|---|
| 3,871,545 | 3/1975 | Bereziat | 215/251 |
| 5,143,236 | 9/1992 | Gueret | 215/249 |
| 5,316,163 | 5/1994 | Von Schuckmann | 215/249 |
| 5,335,801 | 8/1994 | Lee | 215/249 |
| 5,456,374 | 10/1995 | Beck | 215/251 |
| 5,588,562 | 12/1996 | Sandler et al. | 215/252 X |
| 5,829,611 | 11/1998 | Beck | 215/252 |

FOREIGN PATENT DOCUMENTS

| | | |
|---|---|---|
| 0 457 107 | 11/1991 | European Pat. Off. . |
| 2 698 613 | 6/1994 | France . |
| 2 315 173 | 10/1974 | Germany . |
| 35 44 109 | 6/1987 | Germany . |

*Primary Examiner*—Stephen P. Garbe
*Assistant Examiner*—Niki M. Eloshway
*Attorney, Agent, or Firm*—Browdy and Neimark

[57] ABSTRACT

The invention relates to a closure (1) for the security closure of containers. It is usefully applied in the field of diagnosis and especially on containers full of a chemical reagent into which a sample of a substance to be analysed is injected. The closure (1) is provided with a cap (2) having at least one portion (3) made of a material which can be pierced by a syringe needle. The portion (3) is covered by a cover (4). The cap (2) is associated to a first security ring (5) such as to detach from the cap (2) in an axial direction to the container. A second security ring (6) is associated to the cover in such a way as to detach therefrom following a raising of the cover (4) so as to uncover the pierceable portion (3) and permit a needle to be introduced into the container.

3 Claims, 1 Drawing Sheet

CAPSULE FOR SECURITY CLOSURE OF CONTAINERS

DESCRIPTION

Figure 1:
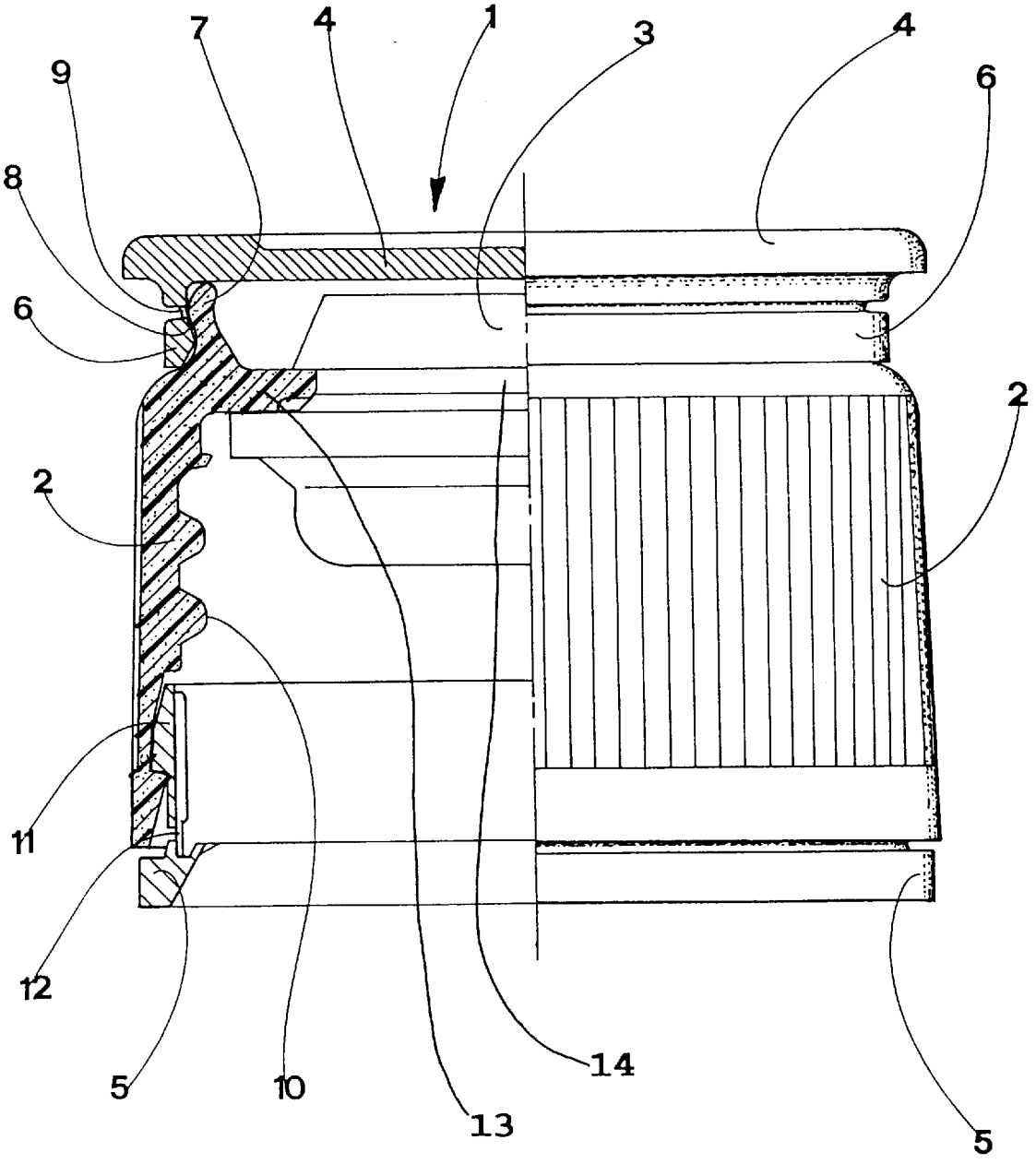

As is seen in FIG. 1, the rigid skirt portion 2 also includes a second annular projection or flange 13 which projects inward (internal to the central aperture) in a radial direction;. The flange 13 is enclosed in an annular perimetrical groove of the rubber portion 3.

1. Technical Field

The invention relates to a security closure for containers. Specifically though not exclusively the closure is applied in the diagnostic field for practically and swiftly carrying out analyses of samples of substances. In particular reference is made to a closure of the type comprising a cap for closing a container, having a rigid skirt portion with a central aperture and a pierceable portion mounted in the central aperture; the pierceable portion is made of a material able to be pierced by a needle and is destined so to be pierced for injection of a substance into the container; a first security ring is connected by frangible means to the skirt portion such as to detach or distance from the skirt portion following a raising of the cap in an axial direction to the container; a cover is mounted removably on the cap in such a way as to cover the pierceable portion and prevent an introduction of a needle into the container; a raising of the cover leads to an uncovering of the pierceable portion of the cap, enabling a needle to be inserted into the container.

2. Background Art

The prior art teaches a cap for closing a container and provided with at least a portion made of a material able to be pierced using a needle; a cover is mounted on the cap in such a way as to cover the pierceable portion. The cap is screwed on the container and the cover is press-applied on the cap. In use, the cover is removed and the container, previously filled with a chemical reagent, is pierced so as to introduce an analytical sample therein, with a resulting mixture of the sample and the reagent. Thus the analysis can be performed by simple observation, without having to open the container. The injection is carried out by pushing the needle of a syringe through the pierceable portion of the cap.

In such known-type closures there is no guarantee that the container has not been tampered with before use: a miscreant could indeed remove the cover, and using a syringe introduce some substance or other capable of altering the reagent's properties, thereafter re-closing the cover and leaving no trace of fraud.

EP 0457107 discloses a closure cap for infusion or transfusion bottles having a pierceable stopper for the bottle neck and a cap gripping round the underneath of the bottle neck and over the stopper by sprung individual tongues. A slide ring secures the cap in gripping position. A tear-off strip, formed by an annular surface is positioned in the middle of the top of the cap. A closure of the type in object is disclosed by DE 4228090, wherein the cover is interposed between the pierceable portion and the rigid skirt portion of the cap; the cover is provided with a pull-ring, which lifts the detachable portion of the cover to detach it from the rest of the cover.

A drawback of this closure is that it is constructionally complicated and costly to manufacture and is non-practical to use.

DISCLOSURE OF INVENTION

The main aim of the present invention is to obviate the above-mentioned drawback of the prior art by providing a closure of the above-described type which is able to attest to any fraudulent intervention on the closure to which it is applied.

An advantage of the closure is that it is constructionally simple and economical and simple and practical to use.

The above aims and advantages are all attained by the closure of the invention, as it is characterized in the appended claims.

Further characteristics and advantages of the present invention will better emerge from the detailed description that follows, of an embodiment of the invention, illustrated in the form of a non-limiting example in the accompanying drawings, in which:

FIG. 1 shows a partially-sectioned vertical elevation view of the closure of the invention.

With reference to the FIGURE, 1 denotes in its entirety a security closure for containers, comprising a cap for closing a container provided with at least one portion 3 made of a material which can be pierced by a needle. The pierceable portion 3 is destined to be pierced by a needle so that the latter can be introduced into the container. In the example the pierceable portion 3 is constituted by a deformable and axially symmetrical body, preferably made of natural rubber, which is applied by jointing internally of a central aperture present on the upper part of the remaining, more rigid portion 2 of the cap, which is made of a plastic material.

Once the closure 1 has been mounted on a container, the rubber portion 3 closes the mouth thereof and therefore also functions as a gasket.

The rigid plastic skirt portion 2 of the cap exhibits a thread 10 destined to screw-couple with the neck of the container.

The closure 1 further comprises a cover 4, removably mounted on the rigid skirt portion 2 so as to cover the pierceable rubber portion 3 of the cap without leaving any possible way for a needle to be introduced into the container. When the cover 4 is mounted on the cap and the closure 1 is mounted on the container, the rubber portion 3 is thus inaccessible from the outside unless the cover 4 is first removed or at least raised sufficiently for a needle to be inserted.

The rigid plastic portion 2 of the cap is made in one piece with and exhibits an annular projection 7, projecting upwardly in an axial direction and having a undercut surface 8. The cover 4, when contactingly engaged on the rigid skirt portion 2 and covering the rubber portion 3, contacts the upper edge of said annular projection 7.

As is seen in FIG. 1, the rigid skirt portion 2 also includes a second annular projection or flange 13 which projects inward (internal to the central aperture) in a radial direction;. The flange 13 is enclosed in an annular perimetrical groove of the rubber portion 3.

A first security ring 5 is associated to the rigid skirt portion 2 in such a way as to detach therefrom when the cap is raised in an axial direction with respect to the container. The first ring 5 is connected, by means of easy-break ribs 12, to an annular element 11 joint-inserted in a seating afforded on an internal wall of the rigid skirt portion 2. The annular element 11 in use will be drawn by the rigid skirt portion 2 upwards during an unscrewing movement. The first security ring 5 is similar in terms of both constructional and functional characteristics to many known-type security rings.

A second security ring 6 is associated to the cover 4 in such a way as to detach from the cover 4 which allows a needle to be inserted.

The cover 4 and the second security ring 6 are interconnected by an annular element 9 which can be constituted for example by a plurality of ribs arranged crown-fashion. The second security ring 6 is destined to interact with the undercut surface 8 of the annular projection 7, so that even a partial raising of the cover 4 to gain access to the underlying rubber portion 3 causes the annular element 9 to break.

This breakage and the consequent separation of the second security ring 6 from the cover 4 are therefore witness to the rubber portion 3 having been accessed, and provide proof of any tampering with the container.

I claim:

1. A security closure (1) for a container having a container neck defining an axial direction, the closure comprising:

a cap for closing the container, the cap comprising a rigid skirt portion (2) with a central aperture and a pierceable portion (3) mounted in the central aperture, the pierceable portion comprising a material able to be pierced by a needle and destined so to be pierced for injection of a substance into the container;

a cover (4) removably mounted on a top of the skirt portion (2) of the cap to cover said pierceable portion (3) and prevent introduction of the needle into the container until raising of the cover (4) uncovers the pierceable portion (3) of the cap (2) and enables the needle to be inserted into the container;

a first security ring (5), connected by frangible ribs (12) to the skirt portion (2) to detach or distance from said skirt portion (2) following raising of the cap in the axial direction of the container;

a second security ring (6), connected to the cover (4) by frangible members (9) to detach or distance from said cover (4) following a raising of the cover;

the cap (2) including an annular projection (7) which projects upwardly in the axial direction, the annular projection (7) comprising an undercut surface (8) interacting with the second security ring (6) and an upper edge whereon the cover (4) is mounted;

wherein the skirt portion includes a thread (10) destined to screw onto the container neck;

the skirt portion includes an inward flange (13) internal to the central aperture and projecting inward in a radial direction, the inward flange having an inside diameter smaller than a diameter of the annular projection (7);

the pierceable portion (3) is mounted on the inward flange (13); the annular projection (7) is superior in the axial direction to the thread (10) and the inward flange (13); and the annular projection (7) is interposed between the pierceable portion (3) and the frangible members (9) connecting the second security ring (6) to the cover (4).

2. The security closure according to claim 1, wherein the pierceable portion (3) includes an annular perimetrical groove (14) coupled to the inside diameter of the inward projection (13).

3. The security closure according to claim 1, wherein the annular projection (7) comprises rigid plastic.

* * * * *